US005819925A

United States Patent [19]

Brizzi et al.

[11] Patent Number: 5,819,925

[45] Date of Patent: Oct. 13, 1998

[54] RIGID HINGED-LID PACKET FOR THE STABLE PACKING OF GROUPS OF LONG ELEMENTS OF VARIABLE SIZE

[75] Inventors: Marco Brizzi; Umberto Folli, both of Zola Predosa, Italy

[73] Assignee: G.D. S.P.A., Bologna, Italy

[21] Appl. No.: 821,913

[22] Filed: Mar. 21, 1997

[30] Foreign Application Priority Data

Mar. 22, 1996 [IT] Italy ..... B096A0162

[51] Int. Cl.[6] ..... B65D 85/10

[52] U.S. Cl. ..... 206/268; 206/273; 229/160.1

[58] Field of Search ..... 206/242, 261, 206/265, 268, 271, 273; 229/160.1, 101

[56] References Cited

U.S. PATENT DOCUMENTS

| | | | |
|---|---|---|---|
| 4,850,482 | 7/1989 | Campbell . | |
| 5,150,720 | 9/1992 | Focke et al. | 206/273 |
| 5,158,664 | 10/1992 | Colgan et al. . | |
| 5,314,062 | 5/1994 | Wu et al. | 229/160.1 |
| 5,439,105 | 8/1995 | Focke . | |
| 5,480,025 | 1/1996 | Draucker et al. | 229/160.1 |

FOREIGN PATENT DOCUMENTS

| | | |
|---|---|---|
| 0 443 365 | 8/1991 | European Pat. Off. . |
| 522469 | 6/1940 | United Kingdom . |

*Primary Examiner*—Paul T. Sewell
*Assistant Examiner*—Luan K. Bui
*Attorney, Agent, or Firm*—IP Group of Pillsbury Madison & Sutro LLP

[57] ABSTRACT

The rigid packet with hinged lid includes a container for a group of long elements and a lid hinged at a top, open end of the container, each having a front, a back and two sides; inside the container, fixed to and partly protruding from the latter, there is a collar with three consecutive flaps which have one or more notches defining respective tabs, hinged with their hinged side to the collar, folded inwards in the container and in contact with the group of long elements so as to form flexible compensation elements which recover the play present between the container and the group of long elements due to the reduction of the size of the latter compared to the fixed internal dimensions of the container.

12 Claims, 3 Drawing Sheets

RIGID HINGED-LID PACKET FOR THE STABLE PACKING OF GROUPS OF LONG ELEMENTS OF VARIABLE SIZE

BACKGROUND OF THE INVENTION

The present invention relates to a rigid hinged-lid packet for the stable packing of groups of long elements of variable size.

The present invention is particularly useful in the packing of cigarettes, to which the following description refers, although without limiting the general possibilities for application of the present invention.

Rigid hinged-lid cigarette packets usually have the shape of a rectangular parallelepiped and are divided into a container for the group of cigarettes covered by an internal wrapper, and a lid, hinged to a top open end of the container. Both the container and the lid have a front, a back and two sides.

A collar is provided inside the container, this collar having two fold lines which define a central front section and two side wings designed to make contact with the internal faces of the container's front and sides, as well as those of the lid when the lid is closed. The collar, usually fixed to the container, protrudes from the top of the latter and acts as a support and holding element for the lid.

The holding function is improved by a pair of tabs defined by a pair of notches. The tabs are coplanar with the front section and protrude from front section in such a way that they interact with the internal surface of the sides of the lid when the lid is closed.

The internal dimensions of the packet are defined according to the size of the group of cigarettes, so that they are substantially the same, thus avoiding possible movement of the group of cigarettes inside the container, which leads to deterioration of the cigarettes due to the loss of tobacco.

In most cases, the cigarettes in each group, especially for groups of twenty cigarettes, are arranged in three rows or layers.

Although this layer arrangement remains the same, the transversal dimensions of the group are modified with variations in the number of cigarettes which form the group and/or variations in the diameter of the cigarettes.

In particular, if a wrapping or packing machine, set up to create packets of given dimensions, is required to package groups of cigarettes whose transversal dimensions are less than those given dimensions, a series of operations are necessary to put right the consequences of packet oversizing.

First, smaller blanks must be used. This entails changes both to the blank-making machines and the printing machines, as well as necessitating adjustments to the wrapping machines, modifying or substituting all of their "size" parts, with the obvious practical and economic disadvantages.

For this reason, to overcome the aforementioned disadvantages, in U.S. pat. Nos. 5,158,664 and 5,439,105 the conventional collar is substituted with a different collar which, at its sides, has relatively complex box structures, obtained by giving the collar fold lines about which the wings are folded, so as to obtain respective thickness designed to occupy the space left inside the packet by missing cigarettes, or by cigarettes having a smaller diameter.

Obviously, the use of the type of collars has its disadvantages, since the collars are relatively complicated to make, involving a series of complex folding movements, which may slow down operation of the packing machines.

SUMMARY OF THE INVENTION

The object of the present invention is to overcome the abovementioned disadvantages by creating a rigid hinged-lid packet suitable for the stable packing of groups of cigarettes of different dimensions, maintaining the dimensions of the packet itself constant.

The present invention relates to a rigid hinged-lid packet for the stable packing of groups of long elements of variable size, the packet having the shape of a rectangular parallelepiped and including a container for the group of long elements, the latter already covered by a wrapper, and a lid hinged to a top open end of the packet, both having a front, a back and two sides; there being inside the container, a collar with at least three consecutive flaps formed by a central front section, designed to make contact with the internal face of the fronts and two first side wings, designed to make contact with the internal faces of the sides, characterized in that at least one of the flaps of the collar has at least one notch defining a tab which is hinged on its hinged side to the collar, folded inwards in the container, its free side being in contact with a group of long elements, so as to form a flexible compensation element which takes-up the play between the container and the group of long elements created by the reduction in the dimensions of the latter compared with the fixed internal dimensions of the container.

BRIEF DESCRIPTION OF THE DRAWINGS

Further characteristics and advantages of the invention are apparent from the detailed description which follows, with reference to the accompanying drawings, which illustrate preferred embodiments of the invention by way of example and in which.

DETAILED DESCRIPTION OF THE PREFERRED EMBODIMENTS

Figure 1:
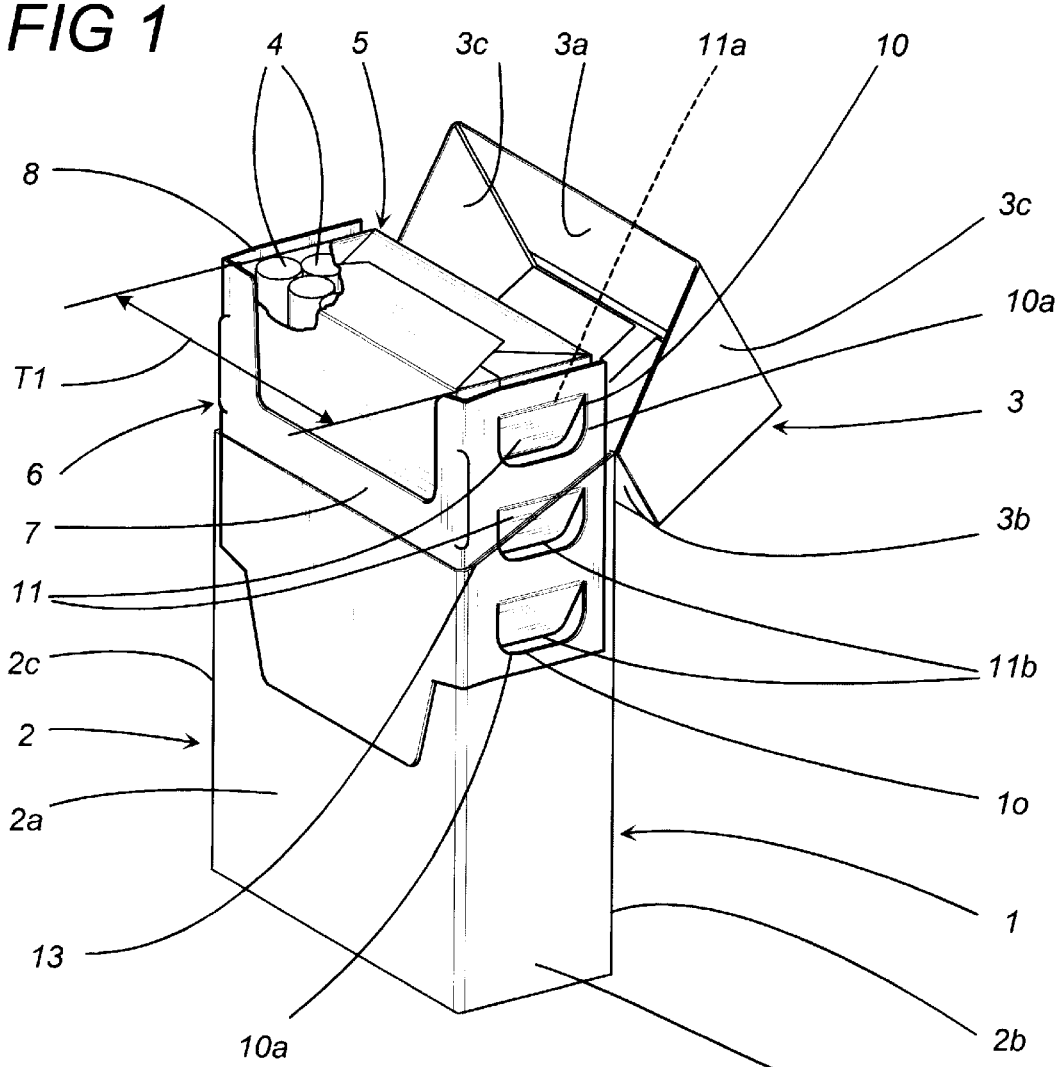
FIG. 1 is a perspective view of a first embodiment of the packet disclosed, shown in its open configuration and with the relative group of long elements.
Figure 5:
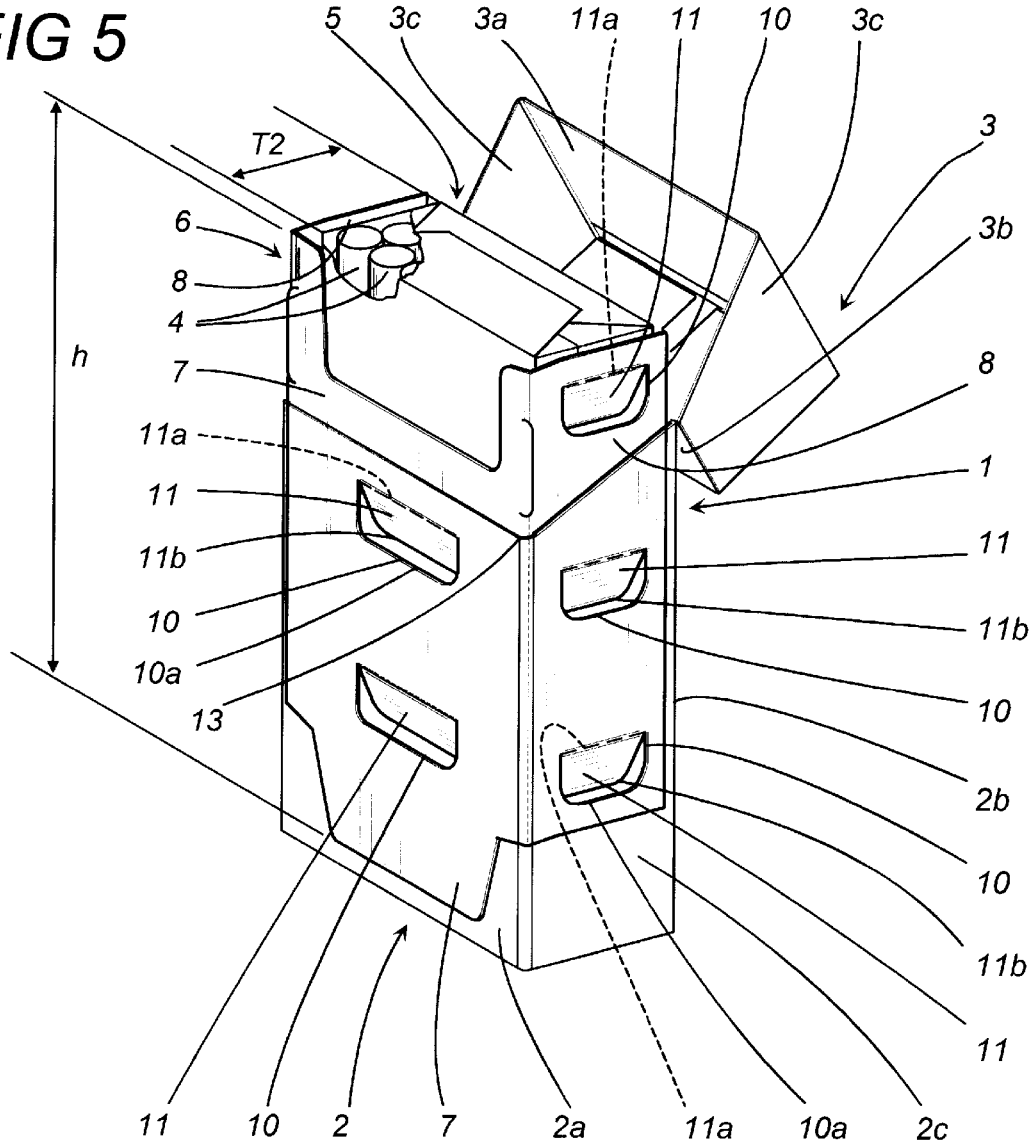
FIG. 5 is a perspective view of a possible embodiment of the packet disclosed, shown in its open configuration.

With reference to FIGS. 1 and 5, the number 1 denotes a rigid packet with the shape of a rectangular parallelepiped, designed to house a group of cigarettes 4 which is ready covered by an internal wrapper 5. The packet 1 includes a container 2, inside which the group of cigarettes 4 is positioned, and a lid 3 hinged at a top end 13 of the container 2 so that it turns between a position in which the end 13 is open and a position in which it is closed.

Both the container 2 and the lid 3 have a set of walls which respectively constitute a front 2*a*, 3*a* and a back 2*b*, 3*b*, which are opposite to and parallel with one another, and two sides 2*c*, 3*c* which are parallel with one another and perpendicular to the front 2*a* and the back 2*b*.

Inside the container 2, there is a collar 6 which, in the embodiments illustrated in FIGS. 1, 2, 5 and 6, has three consecutive flaps, joined to one another by fold lines, forming a central front section 7 and two first side wings 8.

The collar 6 is designed to be fixed inside the container 2, e.g.; by gluing, so that when the lid 3 is in the position which closes the end 13 of the container 2, its front section 7 makes contact internally with the fronts 2*a* and 3*a* of the container 2 and lid 3, and its first wings 8 make contact internally with the sides 2*c* and 3*c* of the container 2 and lid 3.

Once fixed to the container 2, the collar 6 forms a U-shape and partially protrudes from the end 13 of the container 2, acting as a support and holding element for the lid 3. At least one of the flaps on the collar 6 has at least one notch 10, made along an open line 10*a* and defining a tab 11 on the flap. The tab 11 is attached to the collar 6, but can rotate about its hinged side 11*a* which connects the two ends of the notch 10; it can, therefore, turn about its hinged side towards the inside of the container 2, and form a flexible compensation element whose free side 11*b* makes contact with the group of cigarettes 4. In this way, the tab 11 takes-up the play between the container 2 and the group of cigarettes 4, if the dimensions of the latter are reduced compared with the internal dimensions of the container 2.

With reference to the above, it must be emphasized that any number of notches 10 may be provided on each flap of the collar 6, depending on the number of tabs 11 required for the correct stabilization of the group of cigarettes 4 inside the container 2.

Figure 2:
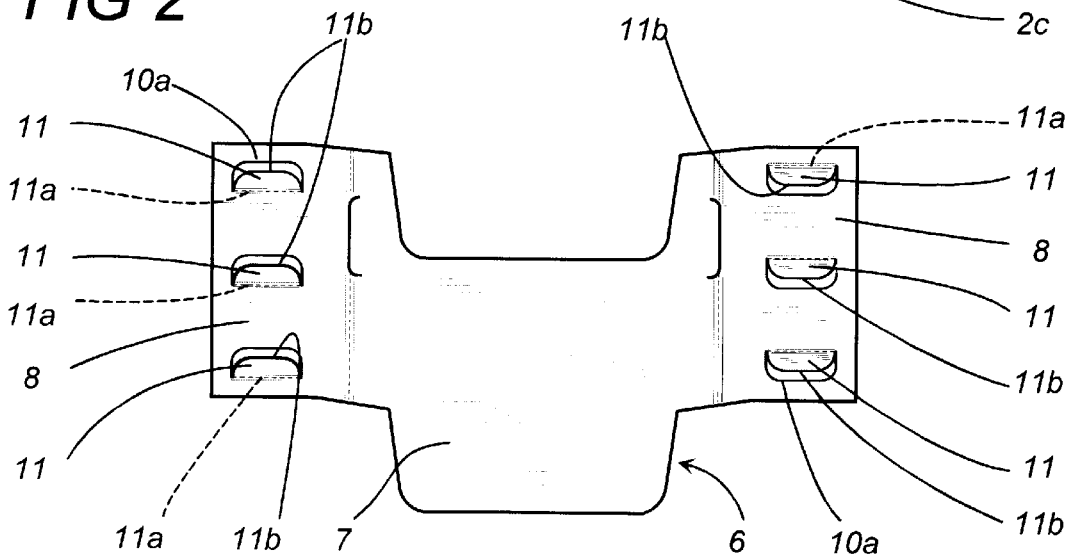
FIGS. 2, 3 and 4 illustrate a plan view, in different scales, of three alternative embodiments of a detail of the packet disclosed, and in particular of the collar.
Figure 6:
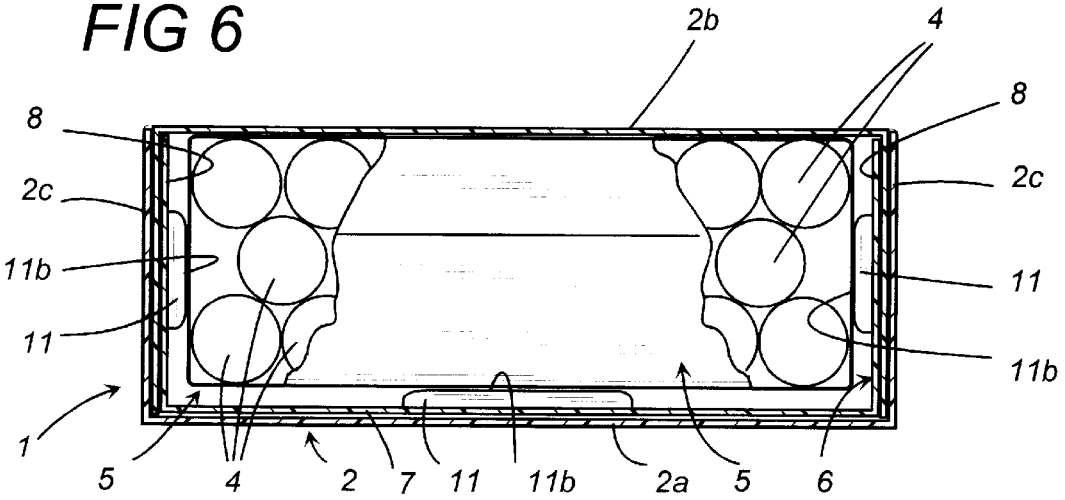
FIG. 6 is a plan view from above, scaled-up and with some parts cut away to better illustrate others, of the packet shown in FIG. 5.

As shown in FIG. 1, the notches 10 are made in one of the two side wings 8 of the collar 6, there being three notches. This type of solution is envisaged when the transversal dimension T1 of the group of cigarettes, parallel with the front 2*a* of the container 2, is reduced, e.g. when the number of cigarettes 4 is reduced, although the number of rows of cigarettes 4 remains the same. Again in such a case, the collar 6 may have notches 10 on both of its flaps which form the first side wings 8, as shown in FIG. 2. If the group of cigarettes 4 has a reduced transversal dimension T1 and transversal dimension T2 parallel with the sides 2*c* of the container 2, i.e. if there are less cigarettes 4 than the conventional group of twenty cigarettes and/or their diameter is smaller, the collar 6 may have notches 10 and the corresponding tabs 11 both on the flap which forms the front section 7, and on the two side wings 8, as shown in FIGS. 5 and 6. In particular, as illustrated in FIG. 5, the packet 1 has a collar 6 with a height h such that the first side wings 8 extend along almost the entire length of the sides 2*c* of the container 2; in this way, it is envisaged that the tabs 11 also act upon the bottom part of the group of cigarettes 4, and it is possible to guarantee greater flexible stability of the group of cigarettes 4 inside the container 2.

Figure 3:
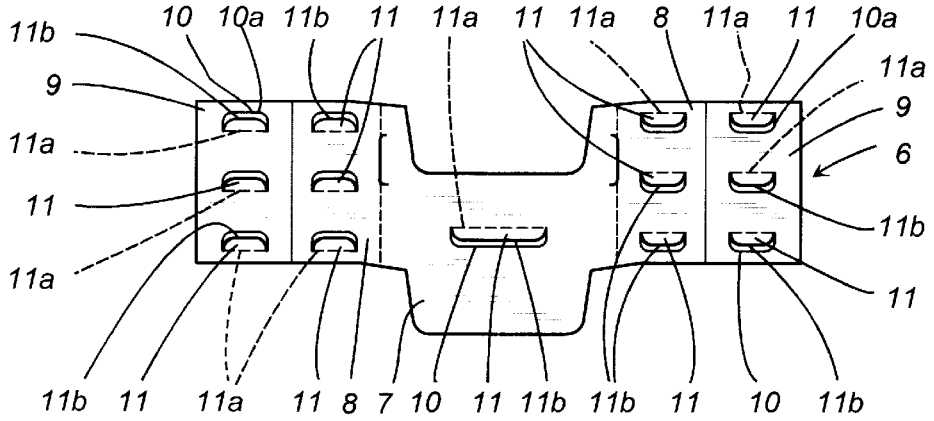
Figure 4:
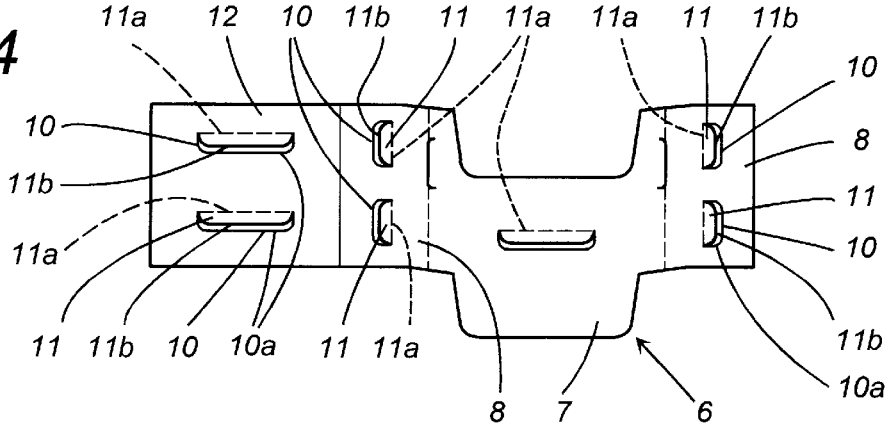
Figure 7:
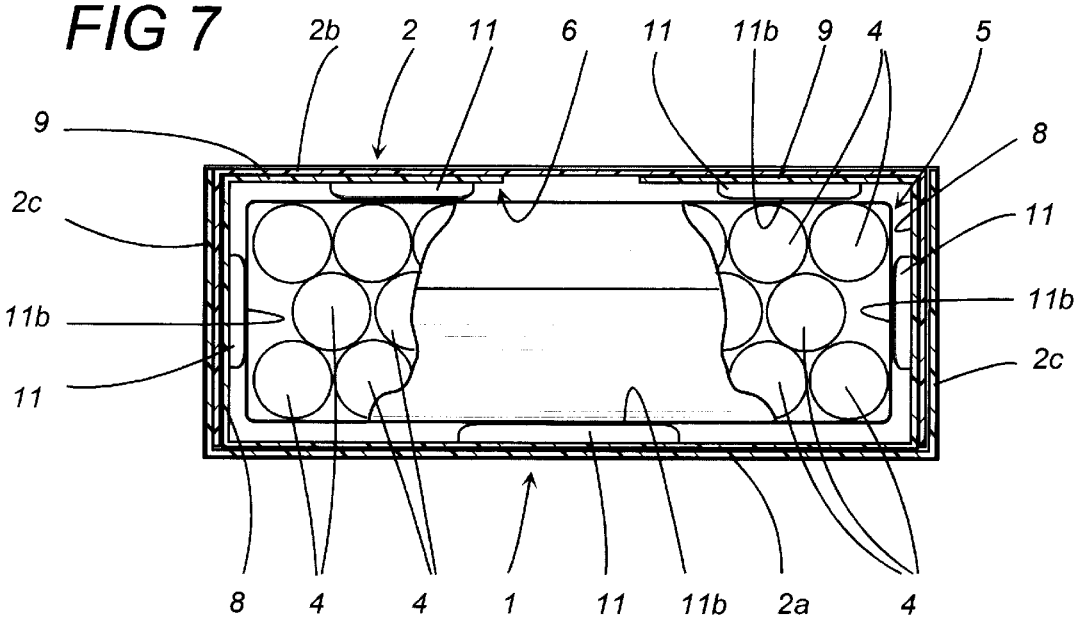
FIG. 7 is a plan view from above, scaled-up and with some parts cut away to better illustrate others, of the packet disclosed, using the detail shown in FIG. 3.

As shown in FIGS. 3 and 7, the collar 6 may have another two flaps, in addition to the three normally envisaged, which constitute two second rear wings 9. In cases such as that illustrated in FIG. 7, where there is a significant reduction in transversal dimensions T1 and T2 of the group of cigarettes 4, the tabs 11 are made in the front section 7 and all of the wings 8 and 9. In particular, as shown in FIG. 4, instead of the rear wings 9, the collar 6 has a single wing 12 as well as the side wings 8, whose transversal dimensions are substantially equal to twice the size of a rear wing 9.

Finally, it should be emphasized that, with reference to the accompanying drawings and the vertical dimension of the packet 1, the so-called hinged side 11*a*, about which the tabs 11 turn when folded inwards into the container 2 until they make contact with the group of cigarettes 4, may be envisaged, for each tab 11, above or below the notch 10. Moreover, the notches 10 can be made in various ways and directions, so that the hinged side 11*a* of the tab 11 is substantially parallel with or transversal to the axial dimension of the cigarettes 4.

As described above, the tabs 11 fulfill the object of the present invention, since it is not necessary to change the size of any parts of the packing machine, constituting an efficient, simple flexible compensation element which recovers the play that may develop between the group of cigarettes 4 with reduced dimensions and the container 2 in the rigid packet 1.

It should be noticed that the tabs 11 could be shaped in a different way to that considered until now. For example, FIG. 1 shows a tab 11*c* which is folded into a square so that one of its faces adheres to the internal wrapper 5 of the group of cigarettes 4, or tab 11*d* which is parallel with a surface of the internal wrapper 5, rather than just a free end 11*b*.

Finally, it should be noticed that the tabs 11 may be shaped in any way, as well as that described, since, for example, they may be formed on the collar 6 by a respective notch 10 and a formed portion of the collar 6 adjacent to the notch 10.

What is claimed is:

1. A rigid, hinged lid packet for the stable packing of a group of elongated elements of variable transverse dimension, said packet having the shape of a rectangular parallelepiped, and comprising:

a container for a group of elongated elements already covered by a wrapper, said container having fixed internal transverse dimensions, and a lid which is hinged at a top open end of the container, each having a front, a back and two opposite sides, all having internal faces;

a collar disposed inside the container, said collar having at least three consecutive flaps including a central front section arranged to make contact with the internal faces of the fronts of the container and lid and two side wings respectively arranged to make contact with the internal faces of two opposite the sides of the container and lid, at least one of said flaps of said collar having at least one notch, each said notch defining a respective tab which is hinged to the collar by a hinged side, each tab being folded inwards towards the inside of the container and having a free edged opposite from said hinged arranged for making contact with the group of elongated elements, thus creating a respective flexible compensation element which takes-up play between the container and the group of elongated elements caused by a reduction in the transverse dimensions of the group of elongated elements compared with the fixed internal dimensions of the container.

2. The packet as defined in claim 1, wherein:

a said flap having a said notch is one of those which constitute one of said two side wings of said collar.

3. The packet as defined in claim 1, wherein:

both of the flaps which constitute said side wings of said collar each have at least said one notch defining a corresponding said tab.

4. The packet as defined in claim 1, wherein:

all of said flaps of said collar, respectively defining said front section and said two side wings each have at least said one notch defining a corresponding said tab.

5. The packet as defined in claim 1, wherein:

the height of the collar is such that said side wings each extend for almost the entire length of the respective said sides of the container, there also being at least one said notch and a respective tab arranged to be close to the lower extent of the group of elongated elements.

6. The packet as defined in claim 1, wherein:

said collar has at least one further flap, constituting a respective rear wing, each said rear wing being positioned so that said rear wing is contiguous with a respective said side wing and arranged to clasp the group of elongated elements at said back of said container, said rear wing having a plurality of notches which define corresponding rear tabs, each rear tab being hinged to the rear wing by a hinged side and being folded inwards towards the inside of the container and having a face side arranged for making contact with the group of elongated elements, thus creating a respective flexible compensating element which takes-up play between the container and the group of elongated elements caused by a reduction in the transverse dimensions of the group of elongated elements compared with the fixed internal dimensions of the container.

7. The packet as defined in claim 6, wherein:

said collar has two said rear wings, each having a plurality of said notches which define corresponding said tabs.

8. The packet as defined in claim 1, wherein:

each flap has a plurality of said notches providing a plurality of said tabs.

9. The packet as defined in claim 1, wherein:

for each said notch, the hinged side of the respective said tab is arranged to be substantially perpendicular to the axial dimension of the group of elongated elements.

10. The packet as defined in claim 9, wherein:

the hinged side of each said tab is positioned, with reference to the vertical dimension of the packet, so as to be located above the respective said notch.

11. The packet as defined in claim 9, wherein:

the hinged side of each said tab is positioned, with reference to the vertical dimension of the packet, so as to be located below the respective said notch.

12. The packet as defined in claim 1, wherein:

for each said notch the hinged side of the respective said tab is arranged to be substantially parallel with the axial dimension of the group of elongated elements.

* * * * *